US006354630B1

(12) United States Patent
Zhang et al.

(10) Patent No.: US 6,354,630 B1
(45) Date of Patent: Mar. 12, 2002

(54) METHOD FOR EMBEDDING NON-INTRUSIVE ENCODED DATA IN PRINTED MATTER

(75) Inventors: Xintong Zhang, Wakefield, MA (US); R. German Linares, Bedford, NH (US); Jonathan Devor, Newton, MA (US); Mohanan Unni, Winchester, MA (US); Kenneth G. Berquist, Andover, MA (US)

(73) Assignee: Inspectron Corporation, Chelmsford, MA (US)

( * ) Notice: Subject to any disclaimer, the term of this patent is extended or adjusted under 35 U.S.C. 154(b) by 0 days.

(21) Appl. No.: 09/375,970

(22) Filed: Aug. 17, 1999

Related U.S. Application Data

(63) Continuation-in-part of application No. 09/135,520, filed on Aug. 17, 1998.

(51) Int. Cl.[7] ..... B42D 15/00

(52) U.S. Cl. ..... 283/70; 283/67; 235/437

(58) Field of Search ..... 283/67, 70, 72, 283/73, 113, 74, 17, 117; 412/1, 11, 14; 358/1.12, 1.18; 235/437, 414, 375, 379

(56) References Cited

U.S. PATENT DOCUMENTS

| | | | |
|---|---|---|---|
| 1,675,769 A | 7/1928 | Smith | |
| 1,817,171 A | 8/1931 | Smith | |
| 3,607,524 A | 9/1971 | Kuhns | 156/220 |
| 4,184,700 A | 1/1980 | Greenaway | 283/6 |
| 4,239,261 A | 12/1980 | Richardson | 283/21 |
| 4,243,734 A | 1/1981 | Dillon | 430/8 |
| 4,360,728 A | 11/1982 | Drexler | 235/462 |
| 4,504,084 A | 3/1985 | Jauch | 283/94 |

(List continued on next page.)

FOREIGN PATENT DOCUMENTS

| | | |
|---|---|---|
| EP | 910 032 | 4/1992 |
| EP | 0 551 016 A1 | 7/1993 |
| EP | 600 646 | 6/1994 |
| EP | 0 651 554 A1 | 5/1995 |
| EP | 0751 475 A2 | 1/1997 |
| WO | WO 95/20291 | 7/1995 |
| WO | WO 99/13391 | 3/1999 |

OTHER PUBLICATIONS

Berghel et al. Protection ownership rights through digital watermarking, Internet Kiosk, Jul. 1996 pp. 101–103.
Cox et al. A Secure, Imperceptable yet Perceptually Salient, Spread Spectrum Watermark for Multimedia, 1996:pp. 192–197, XP 000613940 ISBN # 0–7803–3268–7.
J.F. Delaigle et al. Digital Watermarking, XP 000604065, 1996 SPIE vol. 2659, pp. 99–110.
J.J.K. O Ruanaidh et al. Watermarking digital images for copyright protection, IPA95 Special Section XP 000613938, IEE Proc–Vis. Image Signal Process, Aug. 1996 vol. 143(4).
Kiyoshi Tanaka et al. A Digital Signature Scheme on a Document for MH Facsimile Transmission, Electronics and Communications in Japan, 1991 vol. 74(8) pp. 30–36.
Maxwell T. Sandford II et al. The Data Embedding Method, 1995, pp. 226–259, XP 000601271.

*Primary Examiner*—Willmon Fridie, Jr.
(74) *Attorney, Agent, or Firm*—Lahive & Cockfield, LLP

(57) ABSTRACT

A method for encoding, on an imprintable medium, identification information for identifying the imprintable medium in a manner detectable by a print-monitoring system includes the steps of defining an identification pattern. The identification pattern is imprinted on a print control region so as to be relatively inconspicuous to an unaided human reviewer of the printed matter while remaining detectable to a print monitoring system. The method includes the step of imprinting, at a plurality of locations in the print control region, a plurality of bit characters detectable by the print control system. The spatial distribution of the bit characters encodes information about the identity of the document.

41 Claims, 10 Drawing Sheets

10

U.S. PATENT DOCUMENTS 4,504,357 A 3/1985 Holbein et al. ..... 162/123
4,627,819 A 12/1986 Burrows ..... 434/337
4,790,566 A 12/1988 Boissier et al. ..... 283/91
4,883,291 A 11/1989 Robertson ..... 283/117
4,908,873 A 3/1990 Philibert et al. ..... 382/34
5,018,830 A 5/1991 Krop ..... 350/105
5,031,214 A 7/1991 Dziewit et al. ..... 380/23
5,080,479 A 1/1992 Rosenberg ..... 352/92
5,087,805 A * 2/1992 Silverschutz et al. .. 219/121.71
5,134,669 A 7/1992 Keogh et al. ..... 382/61
5,140,650 A 8/1992 Casey et al. ..... 382/61
5,149,140 A 9/1992 Mowry, Jr. et al. ..... 283/93
5,153,418 A 10/1992 Batterman et al. ..... 235/494
5,178,418 A 1/1993 Merry et al. ..... 283/73
5,189,292 A * 2/1993 Batterman et al. ..... 235/494
5,429,392 A * 7/1995 Loving ..... 283/72
5,444,779 A * 8/1995 Daniele ..... 380/3
5,449,895 A * 9/1995 Hecht et al. ..... 235/494
5,467,169 A 11/1995 Morikawa ..... 355/201
5,530,759 A 6/1996 Braudaway et al. ..... 380/54
5,563,401 A * 10/1996 Lemelson ..... 235/494
5,568,550 A 10/1996 Ur ..... 380/3
5,572,010 A * 11/1996 Petrie ..... 235/494
5,577,774 A * 11/1996 Morikawa et al. ..... 283/93
5,636,957 A 6/1997 Hefty ..... 412/1
5,668,636 A * 9/1997 Beach et al. ..... 358/296
5,684,885 A * 11/1997 Cass et al. ..... 382/100
5,708,717 A * 1/1998 Alasia ..... 380/51
5,748,763 A * 5/1998 Rhoads ..... 382/11
5,752,152 A * 5/1998 Gasper et al. ..... 399/366
5,765,874 A 6/1998 Chanenson et al. ..... 283/67
5,764,774 A 8/1998 Liu ..... 380/49
6,072,871 A 6/2000 Ur ..... 380/51
6,097,497 A * 8/2000 McGraw ..... 358/1.12

* cited by examiner

211

| | | | | |
|---|---|---|---|---|
| 1 | 1 | 0 | 0 | 1 |
| 0 | 0 | 0 | 0 | 1 |
| 0 | 1 | 0 | 0 | 0 |
| 0 | 1 | 0 | 0 | 0 |
| 0 | 0 | 1 | 1 | 1 |

METHOD FOR EMBEDDING NON-INTRUSIVE ENCODED DATA IN PRINTED MATTER

RELATED APPLICATIONS

This application is a continuation-in-part application of U.S. application Ser. No. 09/135,520, filed Aug. 17, 1998, the entire teachings of which are incorporated herein by this reference.

BACKGROUND OF THE INVENTION

Machine-readable code is commonly used for a variety of applications that require some form of verification. For example, print monitoring systems are used to monitor printed matter in some types of paper/sheet handling systems and to make certain control decisions based upon the character of the printed matter. The following is a list of a few conmmon applications:

1. Print quality monitoring: A print monitoring system detects the precision with which the printing system has formed the printed matter and/or the consistency with which the matter is printed across the entire paper. For example, in a laser printing system a print monitoring system detects low-toner situations by recognizing degradation in the contrast of printer's output.
2. Digit control: In an overnight package delivery system, preprinted multi-layered shipping receipts are filled out by the customer. The customer keeps one layer, the package recipient receives another layer with the package, and, typically, a few layers are retained for the carrier's records. Such shipping receipts are typically printed with a package tracking number represented as an alphanumeric sequence on the customer's and recipient's layers of the shipping receipt and encoded as a universal product code (UPC) or bar code symbol on at least one of the carrier's layers of the shipping receipt. The carrier's package tracking system assumes that the package tracking numbers on each layer of the shipping receipt are identical. In such situations, a print monitoring system ensures that the package tracking numbers of each layer match during assembly of the shipping receipt.
3. Sequence control: When mailing personalized advertising and when mailing bills, it is necessary to ensure that all pages of the mailing insert are combined into the proper envelope. This is especially important in the case of confidential information, such as credit card or phone bills. Even if sheet transfer and handling error rates are low, the risk that a wrong bill will be sent to a customer is so unacceptable that a print monitoring system should match each page with the envelope prior to insertion of the bill into that envelope.
4. Verification: There are applications where it is necessary to verify the contents of a particular medium. The machine readable code provides a means to verify the contents of the medium.
5. Matching: In many applications, there is a requirement that two media be matched. A machine readable code can be used to ensure the media are properly matched.

Historically, sequence control has involved closely monitoring the printers, feeders, cutters, folders/accumulators, inserters, and stackers for paper jams or other error conditions. With proper coordination, the right materials generated by the printers can be placed into the correct envelopes or accumulated into the proper packets or publications.

Especially in the case of mailing sensitive material, print monitoring systems have been developed to confirm the insertion of the correct printed matter contents into the correct envelope. To facilitate print monitoring, sequence control information is commnonly placed into the printed matter. For example, both checks and bills have identifying indicia, such as separate identification numbers or customer account numbers, at predetermined locations. The print monitoring system can detect these identifiers and use them as sequence control information to ensure the insertion of all pages of a given bill for a particular account number in a properly addressed envelope and to insure the exclusion of any extraneous pages.

More recently, the introduction of inexpensive production-speed laser printers has made it practical to personalize mailed marketing material, brochures, and other materials for a specific recipient. In these cases, sequence control is critical to avoid disclosure of confidential information to unintended recipients. Unfortunately, in this environment, the inclusion of explicit sequence control information on the printed matter is often unacceptable. For example, letters and marketing brochures with machine readable information at predicable locations will appear, at first glance, to be bills. Consequently, they will be unlikely to generate a favorable impression on the addressee.

SUMMARY OF THE INVENTION

The foregoing disadvantages of the prior art are addressed by a method and system for encoding, on an imprintable medium, information identifying the imprintable medium in a manner detectable by a print-monitoring system. In the method of the invention, a print-control region is first defined on the imprintable medium. Preferably, this print control region is spatially separated from any other information encoded on the imprintable medium The method then includes the step of defining an identification pattern on the print-control region. The identification pattern includes plurality of locations that are selected to identify the imprintable medium. Generally, each location is a region in the print control region on which information corresponding to one character is imprinted. The location can be contiguous or it can be discontinuous and dispersed throughout the print control region in order to reduce the likelihood of unrecoverable errors caused by imperfections in the medium.

The identification information is then placed upon the imprintable medium by imprinting, at each of the locations, one or more bit characters detectable by the print-monitoring system. Thus, each location includes one or more bit characters. The union of bit characters in a particular location designates a particular character. This enables the identification pattern to be detected and decoded by a printmonitoring system.

In the preferred embodiment, the print-control region is defined to be a rectangle having a first comer at a predetermined location on the imprintable medium. In order to assist the print-monitoring system in locating the print-control region, it is preferable to imprint a first framing bit character at the first corner of the print-control region. In order to assist the print-control system in determining the size and extent of the print-control region, the method optionally includes the step of imprinting a second framing bit character at a second corner diagonally opposite the first comer of the print-control region.

The step of defining an identification pattern typically includes the step of defining a sequence of identification characters indicative of the identity of the imprintable medium. Each identifying character is assigned a location in the print-control region. To assist the print-monitoring system in correcting for printing errors, a check character is appended to each of the identification characters so that error correction can be readily be performed. In order to further assist the print-monitoring system in correcting errors, the bit characters used to represent each identifying character can be dispersed throughout the print-control region. By dispersing the bit characters in this manner, the likelihood that any one identifying character will not be irretrievably corrupted by multiple printing errors is significantly reduced.

In the preferred embodiment, the print-control region is a rectangular region having an array of rows and columns, each of which intersects at a slot. In this embodiment, the step of imprinting bit characters on the imprintable medium includes the step of imprinting the bit characters at locations defined by these slots. The resulting array of bit characters organized into rows and columns facilitates decoding by the print monitoring system. Additional error checking is provided by reserving a plurality of parity check slots in the ordered array and imprinting in those reserved parity check-slots a parity-setting bit character, the value of which is selected on the basis of the parity associated with each row and each column.

The present invention is directed to a non-intrusive data encoding technique in which a symbol representative of the data to be encoded on printed matter is detectable only upon close inspection, and is not readily apparent to the intended reviewer of the printed matter. By non-intrusive, it is meant that an observer scanning the printed information content will, more likely than not, fail to recognize the existence of the symbol representative of data to be encoded.

In other embodiments, however, the symbol is rendered substantially invisible to an unaided observer, even upon close inspection of the printed matter. A further advantage is that the symbol can be localized in the printed matter, thereby limiting the size of the image capture device required for detection and the computational burden on any associated processor. In the context of this application, the word "localized" is intended to refer to the designation of a particular region on the printed document that is dedicated to the task of receiving the symbol representative of information to be encoded.

Moreover, the symbol can be located in substantially the same location even between different printing runs of different printed matter. This feature can lower or eliminate the time required to recalibrate the image capture device's position relative to the printed matter.

In general, according to one aspect, the invention concerns printed matter having, printed informational content and a print control symbol. The printed informational content is that content of a given document which is relevant to the intended reviewer, e.g., the printed text of the letter or pictures. The print control symbol is a symbol located at a predetermined position on the printed matter separate from the printed informational content. The print control symbol is hidden such that it is not readily apparent to a reviewer of the printed matter. Typically, the print control symbol encodes information concerning the printed matter, such as sequencing information, which is relevant to the printing system during printing and mailing.

In specific embodiments, the print control symbol comprises a series of bit characters. Preferably, these bit characters are organized into a two-dimensional matrix. The presence or absence of bit characters in the slots or elements of this matrix encodes binary data.

In order to minimize the visual impact of the print control symbol, the bit characters are made as small as possible. Preferably, each bit character is formed from only a few pels of the printer, with imaging capability and minimum web speeds being the limitation on the minimum size of the characters. With current, commercially feasible imaging equipment, the minimum size of the characters is about 0.051 millimeters (mm), although characters as small as 0.025 mm or even smaller can be used in certain applications. On the other end of the spectrum, characters as large as 0.25 mm will be sufficiently inconspicuous for use in certain other applications. Currently, the print characters being used are 0.085 mm in size. The minimum spacing between the centers of adjacent characters is about 0.2–0.4 mm, and more preferably, 0.25 mm. More generally, the spacing is 2–4 times the character size. The variation in relative spacing is about 15%. In a 300 dots per inch (DPI) laser printer, each bit character consists of one. In a 400 DPI printer, each bit characters consist of four pels in a 2×2 square matrix; and in a 600 DPI printer, each bit character can include nine pels in a 3×3 square matrix.

Further, in order to enable accurate decoding by the print monitoring system, the print control symbol preferably comprises data bit characters for encoding not only the print sequencing information, but also error correction information.

In other applications, the principles of the invention are used even where the print control symbol is apparent to the reader. In these applications, the bit characters can be made much larger.

Although the preferred embodiment of the invention concerns laser printing on paper or similar material, the principles of the invention have broader applicability and can readily be adapted to other forms of printed matter. Among the diverse materials that can be readily imprinted according to the principles of the invention are semiconductors, glassware, and fabrics.

According to another aspect, the invention also features a method for imprinting information on printed matter. In the method of the invention, printed informational content and print control symbols are both imprinted at predetermined positions on the printed matter. The print control symbol, which encodes sequencing information, is spatially separated from the printed informational content. In general, according to still another aspect, the invention also includes a printing system for imprinting sequence control information on printed matter. This printing system includes a printer that generates printed matter on which is imprinted printed informational content of interest to a human reviewer and a print control symbol for encoding sequence control information.

In preferred embodiments, the printer prints the print control symbol at predetermined positions on the printed matter. These positions are spatially separated from the informational content of the printed matter. The print control symbol itself is configured to be relatively inconspicuous to an unaided human reviewer. Preferably the print control symbol is invisible to the overwhelming majority of unaided human reviewers.

Finally, according to another aspect of the invention, the invention also features a print monitoring method and system.

The print monitoring method comprises generating printed matter that includes both printed informational content and a print control symbol. The print control symbol is then detected and decoded. The information contained in the now decoded print control system is then used to sequence the printed matter.

A printed matter monitoring system includes an image capture device and controller. The image capture device reads at least the print control symbol from the printed matter from the printer and the controller decodes data encoded in the print control system and makes sequencing decisions based upon that decoded data.

The above and other features of the invention including various novel details of construction and combinations of parts, and other advantages, will now be more sparticularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the drawings, like reference characters refer to the same parts throughout the different views. The drawings are not necessarily to scale, emphasis instead being placed upon illustrating the principles of the invention. Of the drawings.

DETAILED DESCRIPTION OF THE INVENTION

Figure 1:
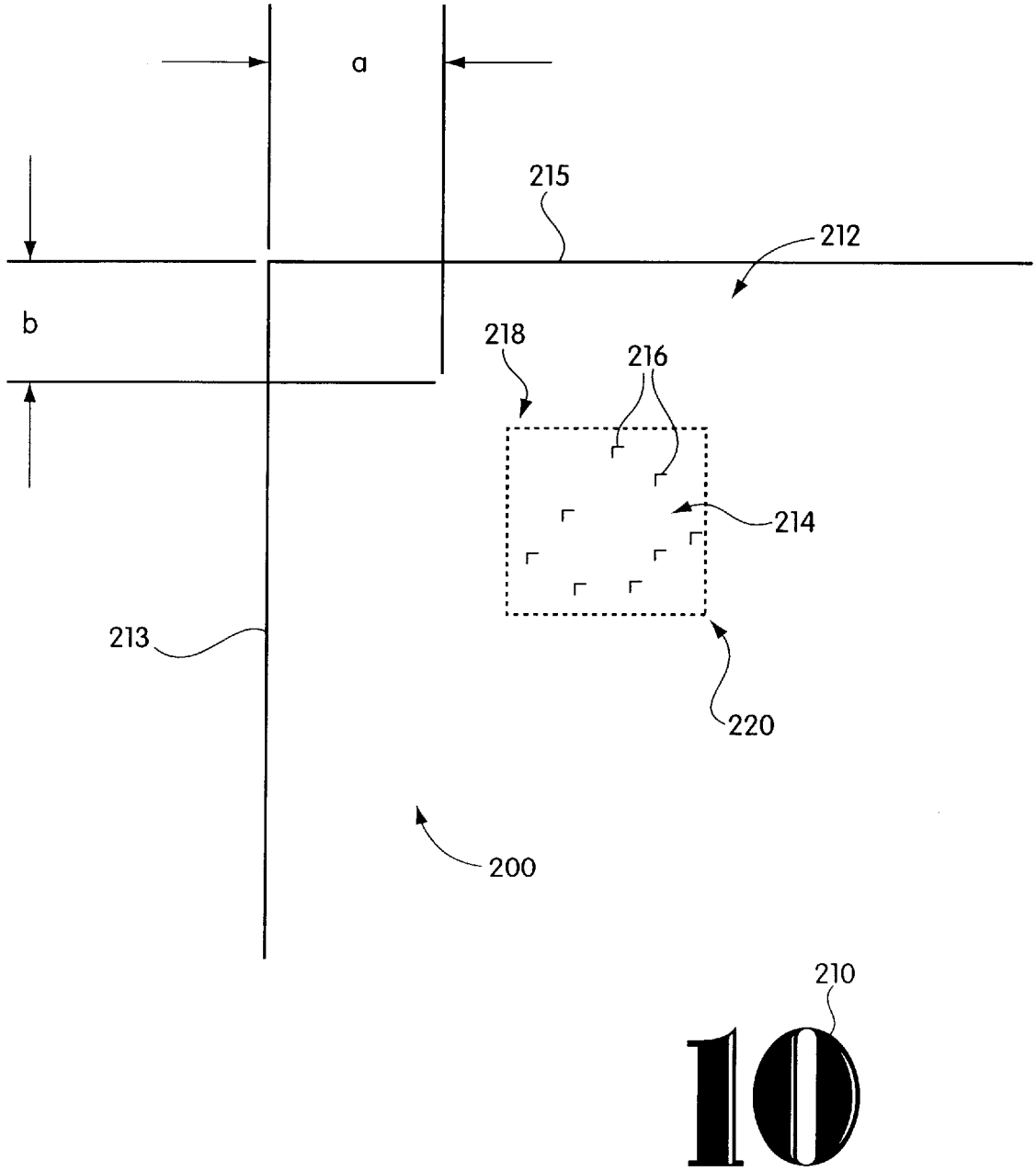
FIG. 1 shows the positioning of the print control symbol on a page of printed matter, according to the present invention.

FIG. 1 shows an example of printed matter 200 configured according to the principles of the present invention. Specifically, the printed matter 200 comprises a page 212 on which printed informational content 210 is printed. The page 212 is indicated on FIG. 1 by a left edge 213 and a top edge 215. This printed information content 210 can be text or an image located on the page 212. The printed matter 200 further includes a print control symbol 214 made up of a plurality of bit characters 216.

The print control symbol 214 is preferably located at a predetermined position on the page 212 which, in the illustrated embodiment, is the upper left hand corner of the page 212. Although it is not imperative that the print control symbol 214 be at a predetermined location, it is preferable that this be the case since a print control symbol 214 at a pre-determined location can then be found more quickly.

Preferably, the print control symbol 214 is separated from the printed informational content 210. In the preferred embodiment, there is approximately 0.250 inches (in.) or 0.625 centimeters (cm) of minimum clear space buffer separating the print control symbol 214 from any printed informational content 210. This clear space buffer allows any print monitoring system to quickly and clearly distinguish the print control symbol 214 from the printed informational content 210.

The preferred size for the bit characters 216 forming the print control symbol 214, is approximately 0.0033 in. (0.0825 millimeters (mm)). The minimum spacing between centers of adjacent bit characters 216 is 0.01 in. (0.25 mm). In the present case, the spacing is 0.015 in. (0.375 mm). Generally, the minimum size of the bit characters 216 is about 0.051 millimeters (mm), although bit characters 216 as small as 0.025 mm or smaller can be envisioned for some applications. On the other end of the spectrum, bit characters 216 as large as 0.25 mm are suitable for certain applications.

The illustrated example of the print control symbol 214 has 4 rows and 5 columns. Each intersection of a row with a column is a slot available for a bit character 216. The presence or absence of a bit character 216 in a particular slot at the intersection of a row and a column encodes binary data representative of print and/or error correction information.

Figures 2, 3:
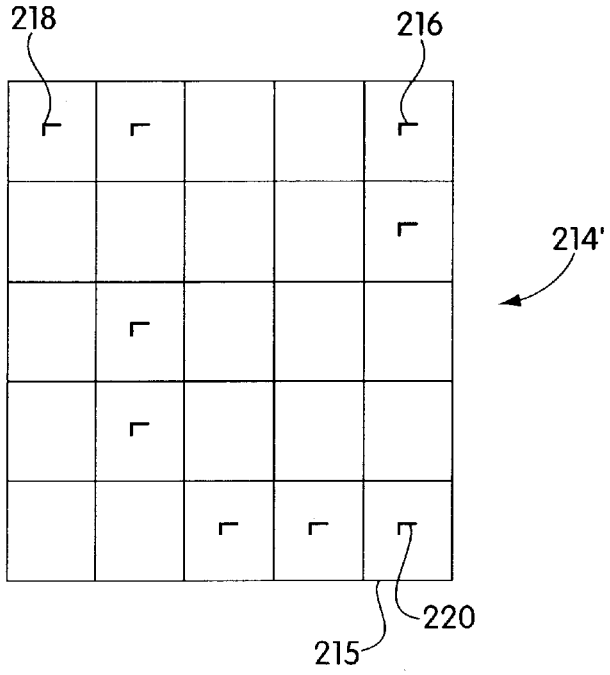
FIG. 2 illustrates the bit character slots in the print control symbol according to the present invention.
FIG. 3 shows the binary values of the slots in the print control symbol.

FIG. 2 is a schematic view of a representative print control symbol 214 having five rows and five columns forming a 25 slot matrix 215 of bit characters 216. In the preferred embodiment, the presence of a bit character 216 in a slot of the matrix represents a binary value of "1" and the absence of a bit character 216 represents the binary value "0" as illustrated in the decoded matrix 211 of FIG. 3.

In the preferred embodiment, a first framing bit 218 is located at an upper, left-most slot and a second framing bit 220 is located at the bottom, right-most slot 220 of the print control symbol 214. These framing bits can be used for frame reference to define the upper left and bottom right corners for a rectangular frame thereby facilitating detection of the print control symbol 214 during print monitoring. Note that the grid of the matrix 215 is shown in FIG. 2 for purposes of explanation only and need not actually be printed. In the preferred embodiment, the matrix 215 of bit characters 216 is framed by clear space, as shown in FIG. 1, to reduce the likelihood of its detection by an unaided human reviewer of the printed matter 200.

It will be understood by one of ordinary skill that the direction "upper-left" and "lower-right" are relative directions whose absolute locations depend on the orientation of the page 212 relative to the direction in which the page is scanned. What is important is that framing bits be made available to designate the extent and location of the rectangular frame in which print control symbol 214 can be found.

The following Table I illustrates the m×n slot positions for an arbitrarily sized m×n matrix:

$$\begin{matrix} a_{1,1} & a_{1,2} & \cdots & a_{1,n-1} & a_{1,n} \\ a_{2,1} & \cdots & \cdots & a_{2,n-1} & a_{2,n} \\ \vdots & & & & \\ a_{m-1,1} & a_{m-1,2} & \cdots & a_{m-1,n-1} & a_{m-1,n} \\ a_{m,1} & a_{m,2} & \cdots & a_{m,n-1} & a_{m,n} \end{matrix}$$

As mentioned above in connection with the discussion of FIG. 2, framing bits 218, 220 in slots $a_{1,1}$ and $a_{m,n}$. These framing bits are always "1."

1. Print Control Symbol with Limited Character Set and Error Correction

In one embodiment, slots $a_{1,n}$, $a_{2,n}$, . . . , and $a_{m-1,n}$ of Table I hold elements that function as odd parity check elements for their corresponding rows 1,2, . . . m−1. These parity check elements are set to make every row have an odd number of 1's. Similarly, slots $a_{m,1}$, $a_{m,2}$, . . . , and $a_{m,n-1}$ function as odd parity check elements for their corresponding columns 1.2 . . . n−1. The remaining slots hold kernel elements for encoding a number plus a check digit. The total number of kernel elements is thus (m−1)·(n−1)−1.

The kernel elements in the symbol matrix 215 are used for encoding a number representative of the print control symbol 214 and a corresponding check digit. In one embodiment, the check digit is a modulo-10 remainder. There are four kernel elements assigned for encoding the check digit for the print control symbol 214. As a result, (m−1)·(n−1)−1−4 kernel elements remain for encoding the number representative of the print control symbol.

Preferably, the number and its corresponding check digit are encoded as the binary numbers with each matrix slot representing a bit. The matrix slots are sequentially arranged from left to right and from top to bottom with the upper-left slot corresponding to the most significant bit (MSB) and the bottom-right slot corresponding to the least significant bit (LSB).

Assume there are N+1 kernel element slots in a print control symbol 214 for encoding an N+1 bit number, i.e., N, N−1, N−2, . . . , N−k, . . . , 1, 0, where bit N corresponds to element $a_{1,2}$ and bit 0 corresponds to element $a_{m-1,n-1}$. In such a case, the positions of the slots for coding a check digit are defined as follows: bit-0 maps to position 0 (matrix element $a_{m-1,n-1}$), bit-1 maps to position (N+1)/3, bit-2 maps to position 2(N+1)/3, and bit-3 maps to position N (i.e., $a_{1,2}$). For example, in a 4×4 matrix, N=7, bits 3 through 0 of the check digit are mapped to elements 7,4,2, and 0 respectively. Thus, a check digit equal to 6, (the binary representation of which is "0110") is encoded into a bit data stream as "0**1*1*0" (from MSB to LSB), where "*" denotes the number to be encoded in the print control symbol 214. In this example, assume that the kernel elements encode the number 6 and that the check digit is also 6 (the binary value of which is also "0110"). The resulting bit stream, with the number and the check digit interleaved, is "00111100". For a print control symbol 214 having a specified size, the above rule fixes the positions of the check digits.

The size of the print control symbol 214 is preferably adapted to the application. To reduce coding redundancy, the number of kernel elements in the matrix 215 is selected to minimize the number of kernel elements needed to encode the largest number (plus a check digit) needed in the particular application. This reduces the likelihood that the print control symbol 214 will be detected by the unaided human reviewer.

A typical print control symbol 214 is encoded as a 5×5 matrix. Of the 25 elements within this matrix 15 (=4·4−1) are available for kernel elements. After removal of the four elements reserved for the check digit, there remain eleven available coding elements. The print control symbol 214 can thus encode a number between 0 to 2047 ($2^{11}-1$) together with its corresponding check digit.

The first step in encoding numeric data in a 5×5 print control symbol 214 is to calculate the bit positions for the check digit. In the foregoing example, N=14. The positions of the bits forming the check digit are therefore 14, 10, 5, and 0. These correspond to elements a, e, j, and p in the following 5×5 matrix:

$$\begin{matrix} 1 & a & b & c & x_1 \\ d & e & f & g & x_2 \\ h & i & j & k & x_3 \\ l & m & n & p & x_4 \\ y_1 & y_2 & y_3 & y_4 & 1 \end{matrix}$$

According to the above calculation, elements 'bcdfghiklmn' are the bits available for encoding the number. In the above matrix, element b is the MSB and element n is the LSB for the encoded binary number while element a and element p are the MSB and LSB respectively for the encoded binary check digit.

For example, the binary code for the decimal number "100", is "1100100". Since there are four slots available for encoding this number, it is necessary to add four leading 0's to generate the fourteen bit stream "00001100100". Since the modulo-10 remainder of the number 100 is 0, the check digit is 0, i.e., "0000" in binary system. The decimal number "100" is thus encoded into the 5×5 matrix by setting the individual elements as follows: a=0, b=0, c=0, d=0, e=0, f=0, g=1, h=1, i=0, j=0, k=0, l=0, m=0, n=0, and p=0 To complete the above 5×5 matrix, values must be assigned to the parity check elements $x_i$, $x_2$, $x_3$, $x_4$, $y_1$, $y_2$, $y_3$, and $y_4$. To do so, it is necessary to first review, the parity of each row. The first row has an odd number of 1's. Consequently, the element $x_1$ should be 0 to keep the number of 1's in this row odd. For similar reasons, the elements $x_2$,$x_3$, and $x_4$ are all set to 0. A similar parity check for each column dictates that elements $y_1$, $y_2$, $y_3$, and $y_4$ also be set to 0.

In an alternative embodiment, the above parity check is replaced by a circular parity check. This is particularly useful where the paper is of low quality or where more decoding accuracy is required. The combination of the parity check and the check digits allows correction of noise. Such noise can be generated by a paper defect that results in a bit character being missed or by a stray mark being interpreted as a character where none was printed.

Figure 4A:
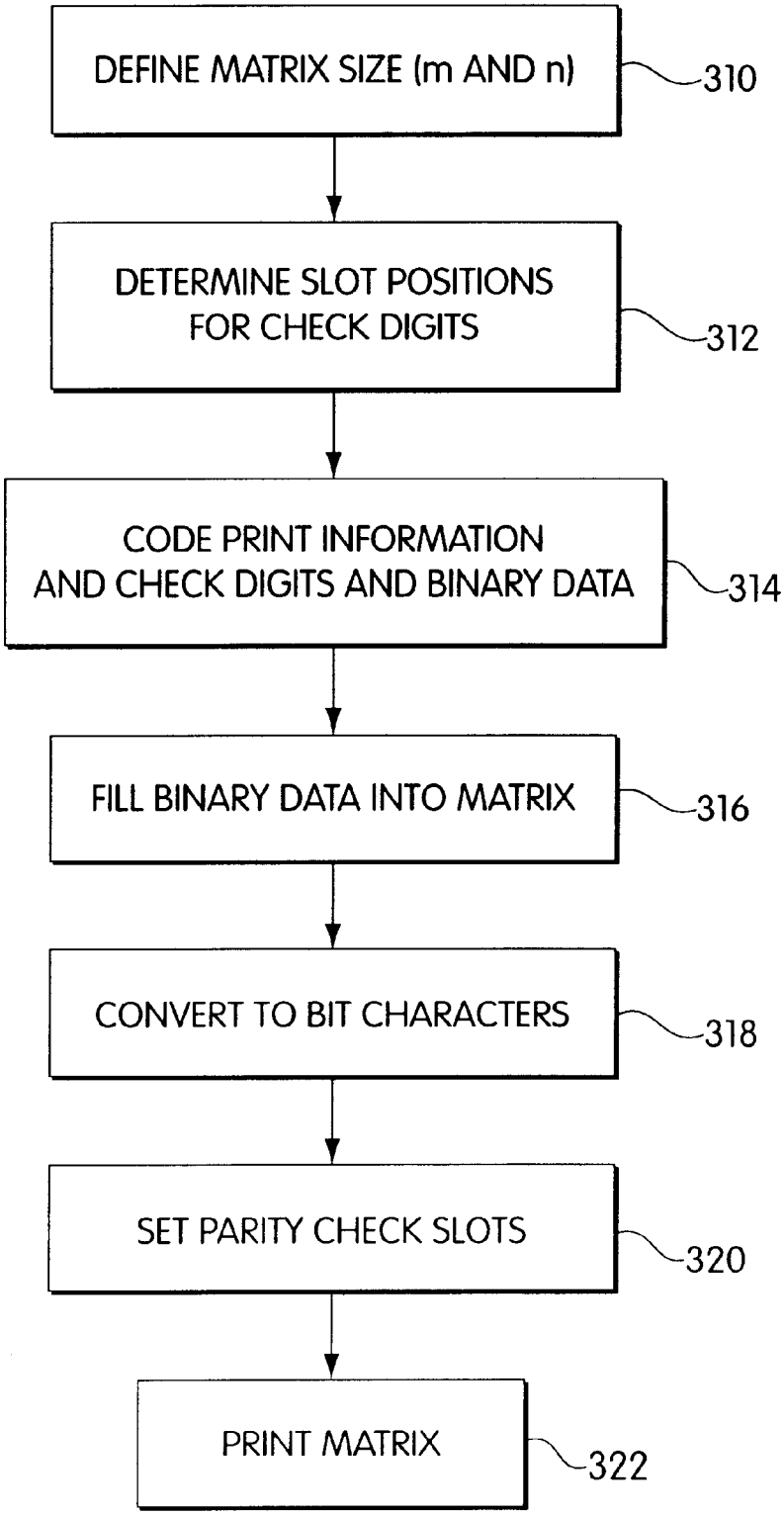
FIGS. 4A and 4B are process diagrams showing the method for generating the print control symbols according to the invention.

Referring now to FIG. 4A, the method of the invention includes a step 310 of defining the number of rows and columns of the matrix 215 for encoding the print control symbol 214. The outcome of this step 310 depends on the amount of data that is to be encoded in the print control symbol 214. Preferably, the matrix 215 should be as small as possible consistent with the amount of data to be encoded. This reduces the likelihood that an unaided human reviewer of the printed matter 200 will detect the print control symbol 214.

The method of the invention further includes the step 312 of determining the slot in which the check digits are to be placed. This step 312 is followed by a step 314 of encoding the number and the corresponding check digits as binary data.

Following step 314, the matrix 215 is filled with 1's and 0's in step 316. In the preferred embodiment, the 1's are encoded as bit characters 216 in the matrix 215. The 0's are then encoded as open areas in the matrix 215, in step 350. In step 320, the parity check slots are set. Specifically, for each row, the parity check slots are set so that there is an odd number of bit characters 216 in each row and an odd number of bit character 216 in each column. Finally, in step 322, the matrix is printed as the print control symbol 214 on the printed matter 200.

2. Print Control Symbol with Extended Character Set and Error Correction a. Symbol Character Encoding for Extended Character Set In the second embodiment, the kernel elements in the dot matrix 215 of Table I are used for encoding an alphanumeric string together with a corresponding check character. A shortened Hamming error correction method is used in which four error correction bits correspond to each six bit encoded alphanumeric character. The total number of bits required for encoding a character is thus ten (six bits for the character itself and four more bits for the check character.) The error correction is a minimum distance 4 code.

The alphanumeric characters are encoded in a base 64 number system. Table II below shows the six bit binary representation for each alphanumeric character together with four error correction bits associated with that character:

TABLE II

Codes for alphanumeric characters

| Value | Char | Pattern EC | Value | Char | Pattern EC |
|---|---|---|---|---|---|
| 0 | — | 000000 0000 | 32 | V | 100000 1010 |
| 1 | 1 | 000001 0011 | 33 | W | 100001 1001 |
| 2 | 2 | 000010 0101 | 34 | X | 100010 1111 |
| 3 | 3 | 000011 0110 | 35 | Y | 100011 1100 |
| 4 | 4 | 000100 0110 | 36 | Z | 100100 1100 |
| 5 | 5 | 000101 0101 | 37 | a | 100101 1111 |
| 6 | 6 | 000110 0011 | 38 | b | 100110 1001 |
| 7 | 7 | 000111 0000 | 39 | c | 100111 1010 |
| 8 | 8 | 001000 0111 | 40 | d | 101000 1101 |
| 9 | 9 | 001001 0100 | 41 | e | 101001 1110 |
| 10 | 0 | 001010 0010 | 42 | f | 101010 1000 |
| 11 | A | 001011 0001 | 43 | g | 101011 1011 |
| 12 | B | 001100 0001 | 44 | h | 101100 1011 |
| 13 | C | 001101 0010 | 45 | i | 101101 1000 |
| 14 | D | 001110 0100 | 46 | j | 101110 1110 |
| 15 | E | 001111 0111 | 47 | k | 101111 1101 |
| 16 | F | 010000 1001 | 48 | l | 110000 0011 |
| 17 | G | 010001 1010 | 49 | m | 110001 0000 |
| 18 | H | 010010 1100 | 50 | n | 110010 0110 |
| 19 | I | 010011 1111 | 51 | o | 110011 0101 |
| 20 | J | 010100 1111 | 52 | p | 110100 0101 |
| 21 | K | 010101 1100 | 53 | q | 110101 0110 |
| 22 | L | 010110 1010 | 54 | r | 110110 0000 |
| 23 | M | 010111 1001 | 55 | s | 110111 0011 |
| 24 | N | 011000 1110 | 56 | t | 111000 0100 |
| 25 | O | 011001 1101 | 57 | u | 111001 0111 |
| 26 | P | 011010 1011 | 58 | v | 111010 0001 |
| 27 | Q | 011011 1000 | 59 | w | 111011 0010 |
| 28 | R | 011100 1000 | 60 | x | 111100 0010 |
| 29 | S | 011101 1011 | 61 | y | 111101 0001 |
| 30 | T | 011110 1101 | 62 | z | 111110 0111 |
| 31 | U | 011111 1110 | 63 | SP | 111111 0100 |

In an optional feature of the invention, position 63 can be used as a switching index instead of as a space. In such a case this bit pattern is interpreted as an instruction to switch to an alternate character set.

b. Check Character

The check character is positioned at the end of the data string. In the preferred embodiment, the check character is obtained by is a modulo 64 SDSR (Sum-Divide-Subtract-Remainder) function (modulo 63 if position 63 is used as a switching index). The selection of the modulo 64 check character for a particular alphanumeric string proceeds as follows:

1) Use Table II to assign a numerical value to every character in the alphanumeric string;
2) Sum the numerical values for all of the characters in the alphanumeric string;
3) Evaluate modulo 64 of the above sum;
4) If the result of step 3 is 0, set the check character value to 0; otherwise, subtract the result of step 3 from 64 and set the check character value to equal this difference;
5) From Table II, obtain the check character corresponding to the check character value from step 4. The foregoing method of obtaining the check character is illustrated in the following example for the alphanumeric string "A206f":

1. The numerical values for the characters "A", "2", "o", "6", and "f" are 11, 2, 10, 6, and 42 respectively (see Table II).
2. The sum of all character values is thus 11+2+10+6+42=71;
3. The value of 71 mod 64 is 7;
4. The check character value is thus 64−7=57;
5. According to Table II, the character corresponding to 57 is "u". Hence, "u" is the check character to be appended to the alphanumeric string "A206f". This results in the alphanumeric string "A206fu" which, by using Table II, is encoded in binary as the 60 bit stream:

0010110001 0000100101 0010100010 0001100011 1010101000 1110010111

It will be clear to one of ordinary skill in the art that the foregoing bit stream will be slightly different when a mod 63 function is used in place of a mod 64 function C. Optimal Matrix Size Assume that an alphanumeric string of n alphanumeric characters, together with one check character, is to be encoded. The total number of bits required to encode this alphanumeric string (including its one check character) is $(n+1)\cdot 10$. Since two additional bits are required to frame the print control symbol 214, the total number of bits required is $(n+1)\cdot 10+2$. The matrix 215 should be selected to be the smallest possible matrix having no less than $(n+1)\cdot 10+2$ elements. This matrix 215 can be either square or rectangular. If the total number of matrix elements is greater than $(n+1)\cdot 10+2$, the extra elements following the end of the encoded data are padded with 1's.

In the previous example, the total number of bits required to encode the print control symbol 214 is 62 (fifty bits for the alphanumeric string, ten bits for the check character, and two more bits for framing the print control symbol 214). The optimal matrix 215 is either 8×8, 9×7 or 7×9. If we select the 8×8 matrix there will be 2 unused elements. These 2 elements are filled out as 1's as described above. The resulting 62 bit data stream encoded in the matrix, including the 1's added for padding is thus:

0010110001 0000100101 0010100010 0001100011 1010101000 111001011111

In an optional feature of the invention, these bits will be randomized and then placed into dot matrix so that the bits corresponding to each character or dispersed throughout the matrix. The framing bits 218, 220 at opposite corners are placed separately. The randomization algorithm is described in the following section.

It is apparennt from the foregoing that if an alphanumeric string of length L is to be encoded in an M×N matrix, then: $M\times N \geqq (10\cdot L)+12$.

The following table demonstrates these relations in a simpler fashion. The axes of the table are the values of M and N, and the entries contain the maximum L (excluding the check character) that can be encoded in an M×N matrix. Note that there are many alternative matrix dimensions with the equivalent capabilities. It is preferable, however to use a square matrix (N=M) for maximum robustness:

TABLE III

Relations between encoding character string length and matrix sizes

| M/N | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|
| 4 | 0 | 0 | 1 | 1 | 2 | 2 | 2 | 3 | 3 | 4 | 4 | 4 | 5 | 5 | 6 | 6 | 6 |
| 5 | 0 | 1 | 1 | 2 | 2 | 3 | 3 | 4 | 4 | 5 | 5 | 6 | 6 | 7 | 7 | 8 | 8 |
| 6 | 1 | 1 | 2 | 3 | 3 | 4 | 4 | 5 | 6 | 6 | 7 | 7 | 8 | 9 | 9 | 10 | 10 |
| 7 | 1 | 2 | 3 | 3 | 4 | 5 | 5 | 6 | 7 | 7 | 8 | 9 | 10 | 10 | 11 | 12 | 12 |
| 8 | 2 | 2 | 3 | 4 | 5 | 6 | 6 | 7 | 8 | 9 | 10 | 10 | 11 | 12 | 13 | 14 | 14 |
| 9 | 2 | 3 | 4 | 5 | 6 | 6 | 7 | 8 | 9 | 10 | 11 | 12 | 13 | 14 | 15 | 15 | 16 |
| 10 | 2 | 3 | 4 | 5 | 6 | 7 | 8 | 9 | 10 | 11 | 12 | 13 | 14 | 15 | 16 | 17 | 18 |
| 11 | 3 | 4 | 5 | 6 | 7 | 8 | 9 | 10 | 12 | 13 | 14 | 15 | 16 | 17 | 18 | 19 | 20 |
| 12 | 3 | 4 | 6 | 7 | 8 | 9 | 10 | 12 | 13 | 14 | 15 | 16 | 18 | 19 | 20 | 21 | 22 |
| 13 | 4 | 5 | 6 | 7 | 9 | 10 | 11 | 13 | 14 | 15 | 17 | 18 | 19 | 20 | 22 | 23 | 24 |
| 14 | 4 | 5 | 7 | 8 | 10 | 11 | 12 | 14 | 15 | 17 | 18 | 19 | 21 | 22 | 24 | 25 | 26 |
| 15 | 4 | 6 | 7 | 9 | 10 | 12 | 13 | 15 | 16 | 18 | 19 | 21 | 22 | 24 | 25 | 27 | 28 |
| 16 | 5 | 6 | 8 | 10 | 11 | 13 | 14 | 16 | 18 | 19 | 21 | 22 | 24 | 26 | 27 | 29 | 30 |
| 17 | 5 | 7 | 9 | 10 | 12 | 14 | 15 | 17 | 19 | 20 | 22 | 24 | 26 | 27 | 29 | 31 | 32 |
| 18 | 6 | 7 | 9 | 11 | 13 | 15 | 16 | 18 | 20 | 22 | 24 | 25 | 27 | 29 | 31 | 33 | 34 |
| 19 | 6 | 8 | 10 | 12 | 14 | 15 | 17 | 19 | 21 | 23 | 25 | 27 | 29 | 31 | 33 | 34 | 36 |
| 20 | 6 | 8 | 10 | 12 | 14 | 16 | 18 | 20 | 22 | 24 | 26 | 28 | 30 | 32 | 34 | 36 | 38 |

For the previous example, the encoding character string length is 5. According to Table III, the optimal matrix size can be 9×7, 7×9, or 8×8. Since the 8×8 matrix is square, it is this matrix that is chosen for encoding the print control symbol 214.

d. Matrix Placement Randomization

The randomization process is added to maximize the effectiveness of the error handling mechanism. Since errors arising from such causes as spots, bad printing or uneven lighting, will usually affect neighboring points, the probability that a character will have multiple bit errors, and thus be uncorrectable, is greatly reduced by randomly dispersing the bits associated with that character throughout the print control symbol 214.

The randomization procedure is based on a one-to-one ordering of every bit in the matrix (with the exception of the framing bits 218, 220 at the top-left and bottom-right corners to a bit-string-array. The same procedure is used to both encode and decode the print control symbol 214.

To determine the correspondence relation between the bit characters 216 in an N×M matrix A and a bit stream of length (M·N)−2, one first scans variable J from 0 to (M−1) inclusively, i.e., from top-to-bottom in the matrix. For each value of J, one then scans variable I from 0 to (N−1) inclusively, i.e., from left-to-right in the matrix. For each combination of I and J, the next value in the bit stream corresponds to the following entry in the matrix:

$$A(I,(FN(I)+FN(J))\bmod M),$$

Where, (mod M, i.e., modulo M) refers to the remainder of the preceding argument, after division by M;

FN is the distance maximization function, which is tabulated in the following Table IV Matrix elements at the diagonal comer, namely elements (0,0) and (M−1, N−1 are ignored since these elements are occupied by the framing bits 218, 220.

TABLE IV

Randomization coefficients.

| | F(0) | F(1) | F(2) | F(3) | F(4) | F(5) | F(6) | F(7) | F(8) | F(9) | F(10) | F(11) | F(12) | F(13) | F(14) | F(15) | F(16) | F(17) | F(18) | F(19) |
|---|---|---|---|---|---|---|---|---|---|---|---|---|---|---|---|---|---|---|---|---|
| M = 4 | 0 | 2 | 1 | 3 | 0 | 2 | 1 | 3 | 0 | 2 | 1 | 3 | 0 | 2 | 1 | 3 | 0 | 2 | 1 | 3 |
| M = 5 | 0 | 4 | 2 | 1 | 3 | 0 | 4 | 2 | 1 | 3 | 0 | 4 | 2 | 1 | 3 | 0 | 4 | 2 | 1 | 3 |
| M = 6 | 0 | 4 | 2 | 1 | 5 | 3 | 0 | 4 | 2 | 1 | 5 | 3 | 0 | 4 | 2 | 1 | 5 | 3 | 0 | 4 |
| M = 7 | 0 | 4 | 2 | 6 | 1 | 5 | 3 | 0 | 4 | 2 | 6 | 1 | 5 | 3 | 0 | 4 | 2 | 6 | 1 | 5 |
| M = 8 | 0 | 4 | 2 | 6 | 1 | 5 | 3 | 7 | 0 | 4 | 2 | 6 | 1 | 5 | 3 | 7 | 0 | 4 | 2 | 6 |
| M = 9 | 0 | 8 | 4 | 2 | 6 | 1 | 5 | 3 | 7 | 0 | 8 | 4 | 2 | 6 | 1 | 5 | 3 | 7 | 0 | 8 |
| M = 10 | 0 | 8 | 4 | 2 | 6 | 1 | 9 | 5 | 3 | 7 | 0 | 8 | 4 | 2 | 6 | 1 | 9 | 5 | 3 | 7 |
| M = 11 | 0 | 8 | 4 | 2 | 10 | 6 | 1 | 9 | 5 | 3 | 7 | 0 | 8 | 4 | 2 | 10 | 6 | 1 | 9 | 5 |
| M = 12 | 0 | 8 | 4 | 2 | 10 | 6 | 1 | 9 | 5 | 3 | 11 | 7 | 0 | 8 | 4 | 2 | 10 | 6 | 1 | 9 |
| M = 13 | 0 | 8 | 4 | 12 | 2 | 10 | 6 | 1 | 9 | 5 | 3 | 11 | 7 | 0 | 8 | 4 | 12 | 2 | 10 | 6 |
| M = 14 | 0 | 8 | 4 | 12 | 2 | 10 | 6 | 1 | 9 | 5 | 13 | 3 | 11 | 7 | 0 | 8 | 4 | 12 | 2 | 10 |
| M = 15 | 0 | 8 | 4 | 12 | 2 | 10 | 6 | 14 | 1 | 9 | 5 | 13 | 3 | 11 | 7 | 0 | 8 | 4 | 12 | 2 |
| M = 16 | 0 | 8 | 4 | 12 | 2 | 10 | 6 | 14 | 1 | 9 | 5 | 13 | 3 | 11 | 7 | 15 | 0 | 8 | 4 | 12 |
| M = 17 | 0 | 16 | 8 | 4 | 12 | 2 | 10 | 6 | 14 | 1 | 9 | 5 | 13 | 3 | 11 | 7 | 15 | 0 | 16 | 8 |
| M = 18 | 0 | 16 | 8 | 4 | 12 | 2 | 10 | 6 | 14 | 1 | 17 | 9 | 5 | 13 | 3 | 11 | 7 | 15 | 0 | 16 |
| M = 19 | 0 | 16 | 8 | 4 | 12 | 2 | 18 | 10 | 6 | 14 | 1 | 17 | 9 | 5 | 13 | 3 | 11 | 7 | 15 | 0 |
| M = 20 | 0 | 16 | 8 | 4 | 12 | 2 | 18 | 10 | 6 | 14 | 1 | 17 | 9 | 5 | 13 | 3 | 19 | 11 | 7 | 15 |

Table IV covers matrices ranging in size from 4×4 to 20×20. However, similar randomization tables of arbitrary size can readily be defined. In the preferred embodiment, however, matrices larger than 20×20 are rarely created.

Figure 4B:
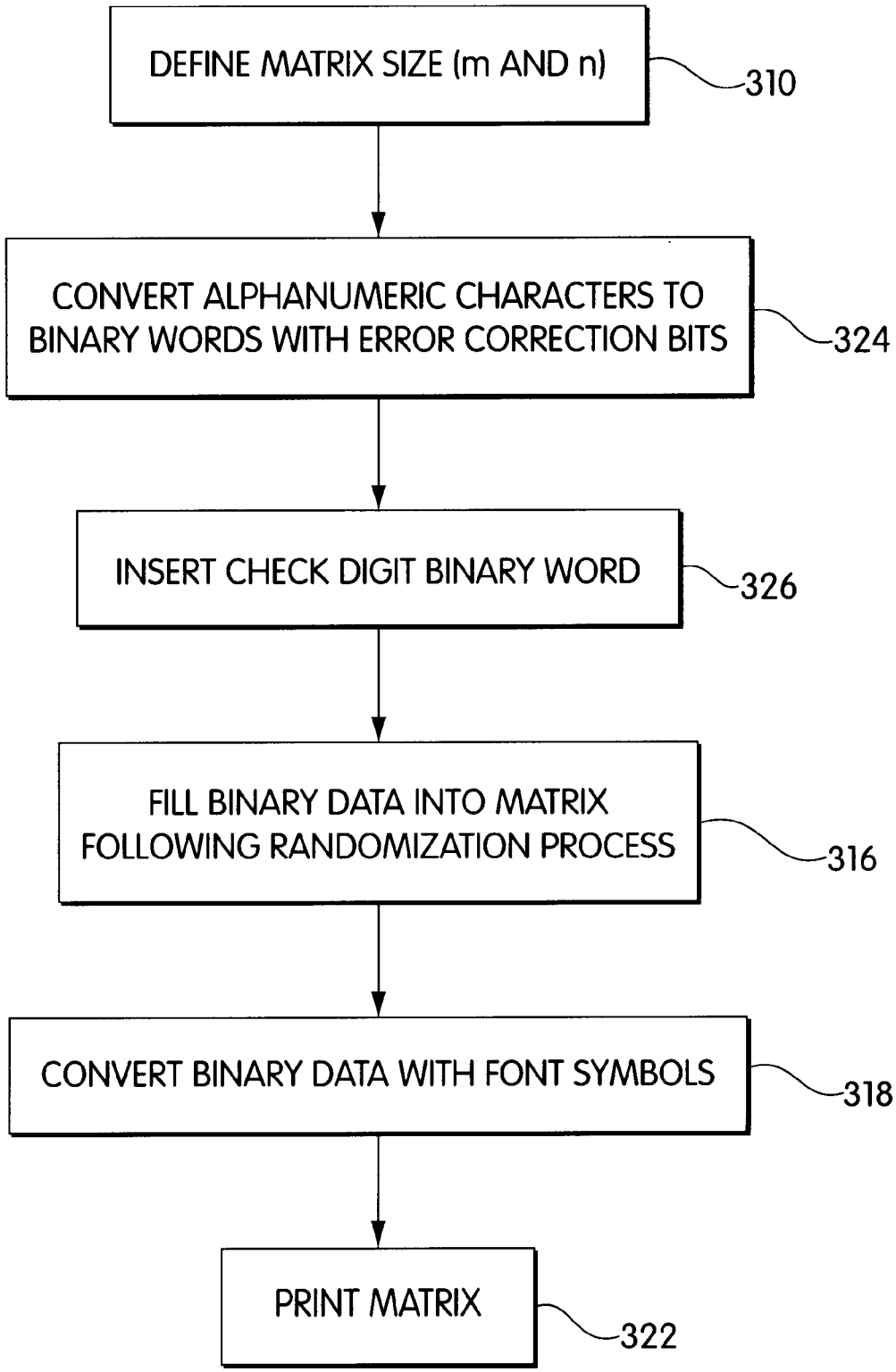

FIG. 4B is a process diagram illustrating the generation of the print control symbol 214 according to the second embodiment in which alphanumeric characters and error correction bits are encoded. The method begins with the step 310 of defining the matrix size. Then, the alphanumeric characters are converted to binary words with the error correction bits according to Table II in step 324. Next, in step 326, the check digit is inserted into the binary word.

In step 316, the binary data thus generated is arranged into a matrix according to the randomization process described above. This binary data is then converted into font symbols in step 350. Finally, the matrix is printed in step 322.

EXAMPLE 1

To demonstrate the randomization method disclosed above, we consider in detail the steps in encoding the string "ABCDEFGHIJKLMNOPQRSTUV" into a 6×4 matrix (N=6, M=4):

The first entry is calculated with [J=0, I=0]:

(I=0, (FN(I=0)+FN(J=0)) (mod M=4))=(0, (FN(0)+FN(0)) (mod 4)))=(0, (0+0) (mod 4))=(0, 0 (mod 4))=(0, 0).

Since this entry corresponds to the framing bit, it is assigned the binary value 1;

The 2nd entry [J=0, I=1]:

(I=1, (FN(I=1)+FN(J=0)) (mod 4))=(1, (FN(1)+FN(0)) (mod 4))=(1, (2+0) (mod 4))=(1,2 (mod 4))=(1,2)

Bit A is assigned to this element in the matrix;

The 3rd entry [J=0, I=2]:

(I=2, (FN(I=2)+FN(J=0)) (mod 4))=(2, ((FN(2)+FN(0)) (mod 4)))=(2, (1+0) (mod 4))=(2, 1 (mod 4))=(2, 1)

Bit B is assigned to this element in the matrix;

The 4th entry [J=0, I=3]:

(I=3, (FN(I=3)+FN(J=0)) (mod 4))=(3, ((FN(3)+FN(0)) (mod 4)))=(3, ((3+0) (mod 4)))=(3, 3 (mod 4))=(3, 3)

Bit C is assigned to this element in the matrix;

The 5th entry [J=0, I=4]:

(I=4, (FN(I=4)+FN(J=0)) (mod 4))=(4, ((FN(4)+FN(0)) (mod 4)))=(4, ((0+0) (mod 4)))=(4, 0 (mod 4))=(4, 0)

Bit D is assigned to this element in the matrix;

The 6th entry [J=0, I=5]:

(I=5, (FN(I=5)+FN(J=0)) (mod 4))=(5, ((FN(5)+FN(0)) (mod 4)))=(5, ((2+0) (mod 4)))=(5, 2 (mod 4))=(5, 2)

Bit E is assigned to this element in the matrix;

The 7th entry [J=1, I=0]:

(I=0, (FN(I=0)+FN(J=1)) (mod 4))=(6, ((FN(0)+FN(1)) (mod 4)))=(6, ((0+2) (mod 4)))=(0, 2 (mod 4))=(0, 2)

Bit F is assigned to this element in the matrix;

The 16th entry [J=2, I=4]:

(I=4, (FN(I=4)+FN(J=2)) (mod 4))=(4, ((FN(4)+FN(2)) (mod 4)))=(4, ((0+1) (mod 4)))=(4, 1 (mod 4))=(4, 1)

Bit P is assigned to this element in the matrix;

The 17th entry [J=2, I=5]:

(I=5, (FN(I=5)+FN(J=2)) (mod 4))=(5, ((FN(5)+FN(2)) (mod 4)))=(5, ((2+1) (mod 4)))=(5, 3 (mod 4))=(5, 3)

Since it is the dot-pattern entry, it is assigned as 1 instead of assigning any bit from encoded bit stream;

The 18th entry [J=3, I=0]:

(I=0, (FN(I=0)+FN(J=3)) (mod 4))=(0, ((FN(0)+FN(3)) (mod 4)))=(0, ((0+3) (mod 4)))=(0, 3 (mod 4))=(0, 3)

Bit Q is assigned to this element in the matrix;

The final result is shown in Table V (a).

In the same exact fashion, a 22-bit bit-stream [1000111100011101101111] would be randomized into the same size matrix (Table V(b)):

TABLE V

Randomization results matrices.

| | | | | | | | | | | | |
|---|---|---|---|---|---|---|---|---|---|---|---|
| 1 | G | S | O | D | K | 1 | 1 | 1 | 0 | 0 | 0 |
| L | R | B | I | P | V | 1 | 0 | 0 | 0 | 1 | 1 |
| F | A | N | T | J | E | 1 | 1 | 1 | 1 | 0 | 1 |
| Q | M | H | C | U | 1 | 1 | 1 | 1 | 0 | 1 | 1 |

(a) (b)

EXAMPLE 2

For the example 001010110001 00100101 0010100010 0001100011 1010101000 1110010111 11 of previous section, the matrix is generated as

TABLE VI

Encoded bit matrix of character-string A206f with check character u.

| | | | | | | | |
|---|---|---|---|---|---|---|---|
| 1 | 0 | 1 | 1 | 1 | 1 | 1 | 0 |
| 0 | 1 | 0 | 0 | 0 | 0 | 1 | 0 |
| 1 | 0 | 0 | 1 | 1 | 0 | 1 | 0 |
| 1 | 1 | 0 | 0 | 0 | 0 | 1 | 0 |
| 0 | 0 | 0 | 0 | 1 | 1 | 0 | 0 |
| 1 | 0 | 0 | 1 | 0 | 1 | 0 | 0 |
| 1 | 0 | 0 | 1 | 1 | 0 | 1 | 1 |
| 0 | 0 | 1 | 1 | 0 | 1 | 0 | 1 |

The size of the symbol can be decided according to the application. To reduce the coding redundancy, the size of the symbol matrix is preferably selected to be just large enough to accommodate the minimum set of available kernel coding elements to encode the maximum number of characters plus a check character that is needed in the particular application.

Further, the shape of the matrix can also be adapted to the application. A square matrix is preferred in most cases because of its compactness. However, very long, rectangular matrices, are also useful. For example, a long matrix extending across the page 212 allows a symbol to be inserted between lines of typed text on the page.

To encode the character string

Data=9XY345 (6 characters)

Calculate the check character:

Check character=b

Using Table II, encode the character string 9XY345b as, 0010010100 1000101111 1000111100 0000110110 0001000110 0001010101 1001101001 (=70 bits).

Calculate the matrix size by looking up Table III,

Matrix size=9×8

Using the randomization and placement algorithm, create the matrix

| | | | | | | | | |
|---|---|---|---|---|---|---|---|---|
| 1 | 0 | 0 | 1 | 1 | 0 | 0 | 0 | 1 |
| 1 | 0 | 1 | 0 | 0 | 0 | 0 | 1 | 1 |
| 1 | 1 | 0 | 0 | 0 | 0 | 0 | 1 | 1 |
| 1 | 1 | 1 | 1 | 0 | 0 | 1 | 0 | 0 |
| 0 | 0 | 1 | 0 | 1 | 0 | 0 | 0 | 1 |
| 0 | 0 | 1 | 0 | 0 | 0 | 0 | 0 | 0 |
| 1 | 1 | 1 | 1 | 1 | 0 | 1 | 1 | 1 |
| 0 | 0 | 0 | 1 | 0 | 0 | 1 | 0 | 1 |

The encoded character string 9XY345 with check character b.

3. Decode Algorithms

Figure 5A:
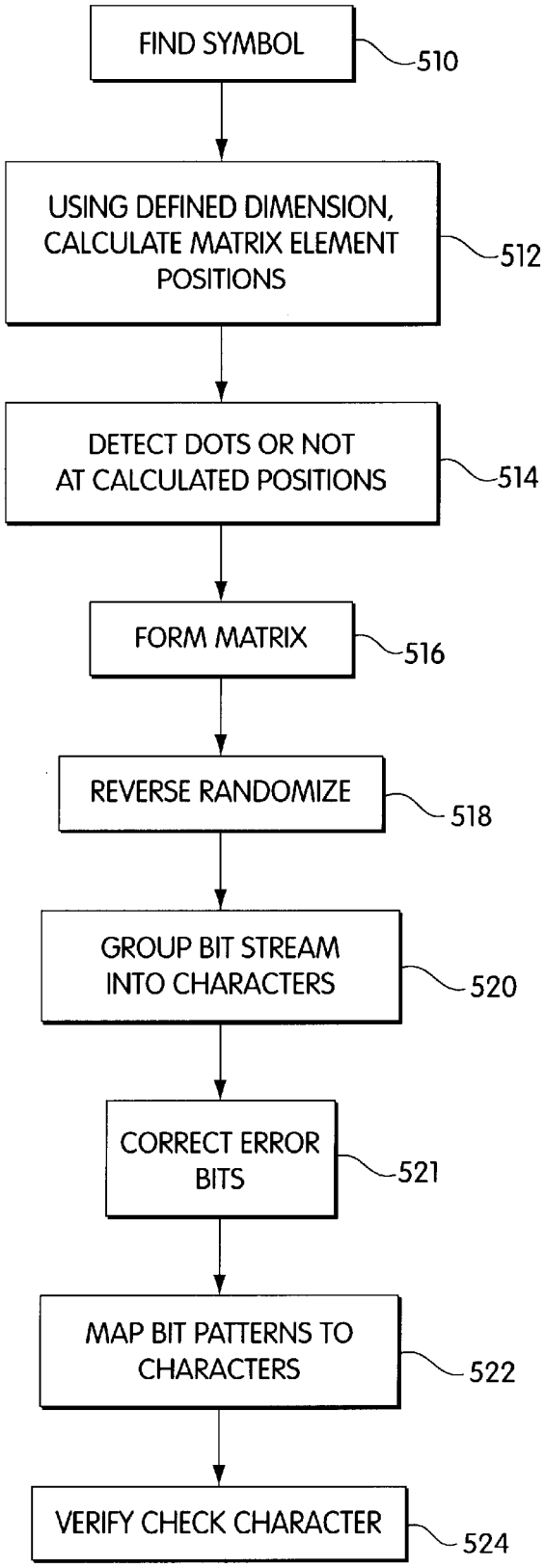
FIGS. 5A and 5B show the decoding algorithms when the size of the symbol is known and unknown, respectively.
Figure 5B:
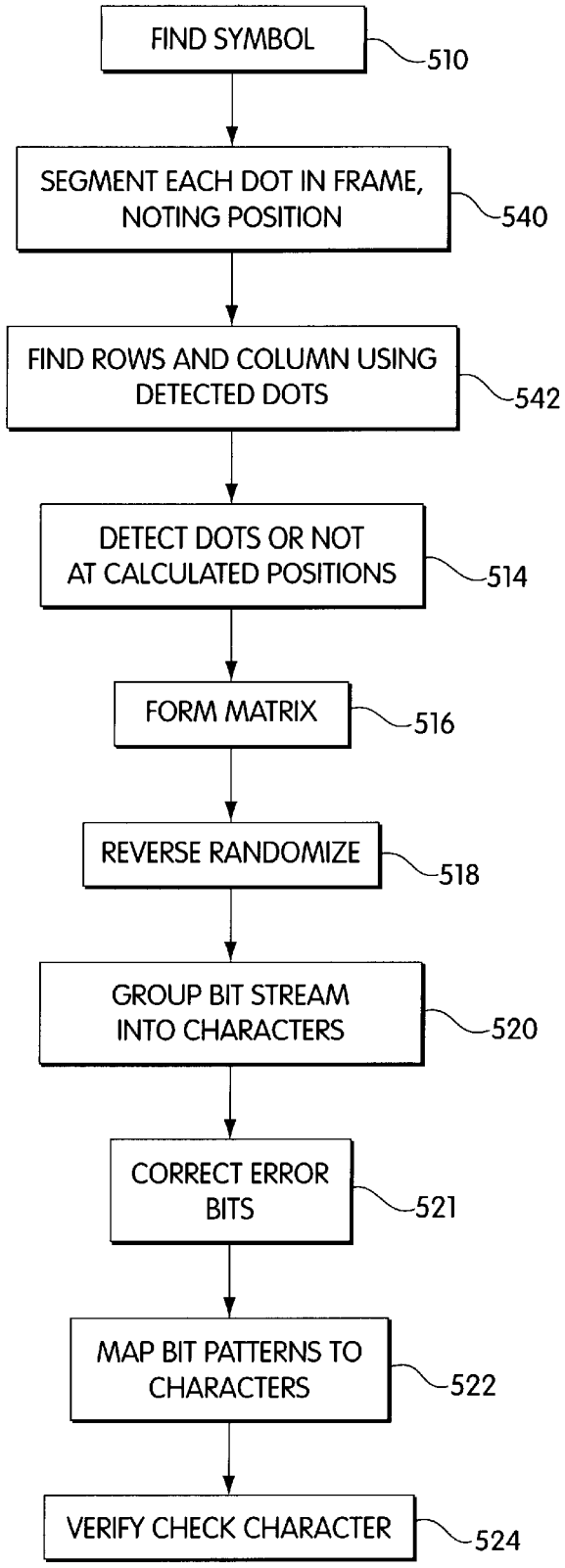

FIGS. 5A and 5B are process diagrams illustrating a technique for decoding the print control symbols 214. FIG. 5A illustrates the process selected when the size of the print control symbol 214 is known. FIG. 5B illustrates a similar process to be used when the size of the print control symbol 214 is unknown.

The process depicted in FIG. 5A begins with the step 510 of locating the symbol on the page. The print control symbol 214 is oriented using framing bits 218, 220. Then, using the defied dimensions and the known symbol size, the positions of each matrix element are calculated in step 512.

In step 514, the presence or absence of bit characters 216 is determined in each of the calculated positions. In step 516, a matrix is formed by assigning bit characters 216 to represent binary "1" and blank spaces to represent binary "zero". Next, in step 518, the encoded bit stream is obtained by performing reverse randomization. Next, in step 520, the bit stream is grouped into groups and any redundant bits are trimmed off. In the case of the second embodiment, each group contains 10 bits. Then, within each bit group, error correction is performed. Having fulfilled their function, the error correction bits are then removed from each character bit pattern. Finally, in steps 522 and 524, bit patterns are mapped to the character using the above tables and check characters are verified.

The method of FIG. 5B is used when the size of the print control symbol 214 is not known before decoding is started. The difference between the method depicted in FIG. 5A and that in FIG. 5B lies in the inclusion of steps 540 and 542. Specifically, the position of each bit character 216 in the symbol is detected and these locations are noted in step 540. Next, the rows and columns of the print control symbol 214 are determined according to the detected bit character positions in step 542. This defines the print control symbol's size.

4. Printing System

Figure 6:
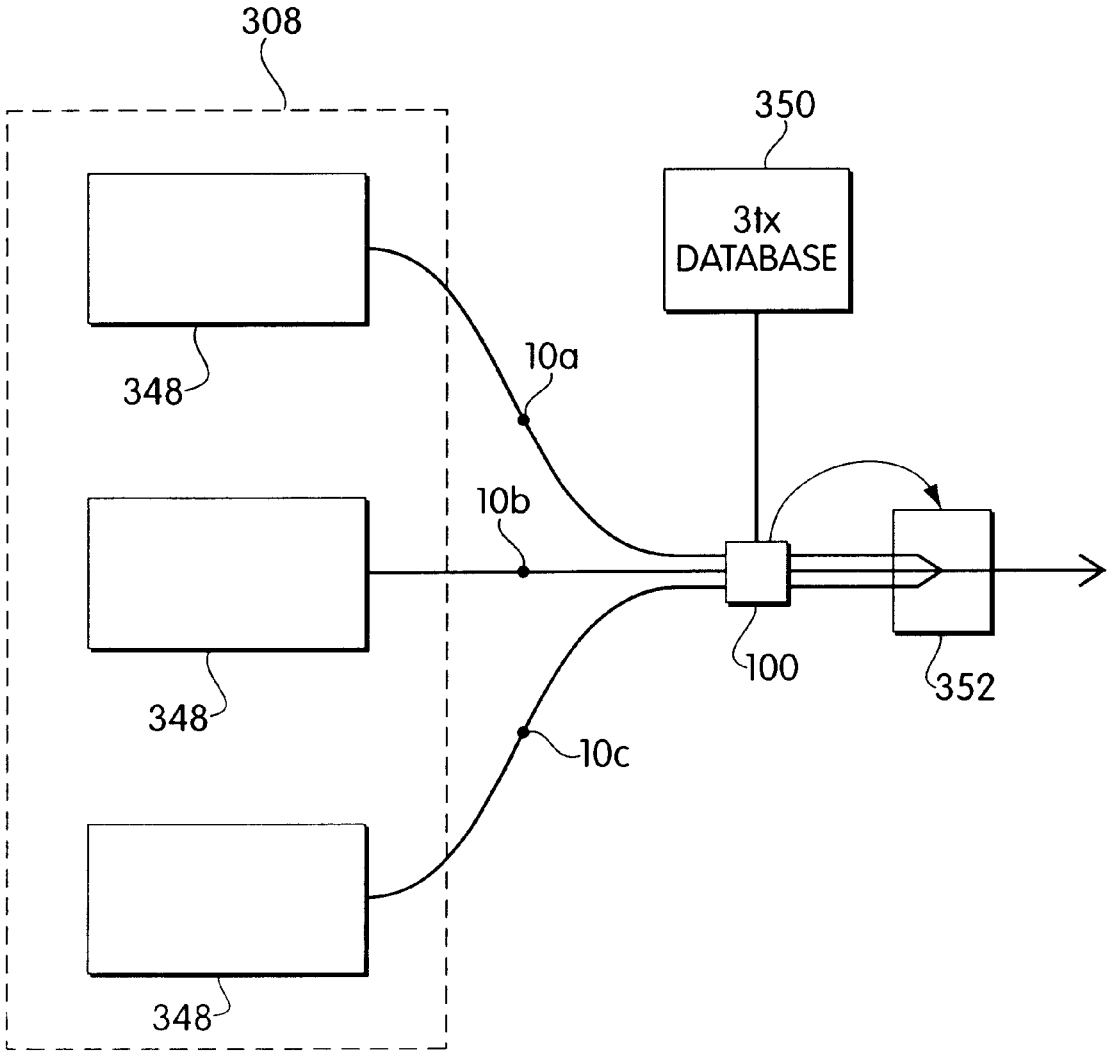
FIG. 6 shows a printing system to which principles of the present invention are applied.

FIG. 6 is a block diagram showing a printing system having sequence monitoring capabilities according to the principles of the present invention. Specifically, the printing system includes at least one, but more typically, multiple printers 348A-348C. Each printer 348A–348C generates a stream of printed matter 109A–10C. At least one of these streams of printed matter 10A–10C has been imprinted with the print control symbol 214 according to the present invention. In the preferred embodiment, the print control symbols encode sequencing information that correlates the streams of printed matter 10A–10C from each of the separate printers, 348A–348C. For example, a print control symbol 214 can correlate printed envelopes from one printer with letters from another printer. In one specific example, the streams of printed matter 10A–10C pass through a print monitoring system 100 that detects the print control symbols in each such stream. The print monitoring system 100 then uses the information gained from analyzing the print control symbols from each stream 10A–10C to control a printed matter manipulator 352. The printed matter manipulator 352 uses sequencing information, for example, from the print monitoring system 100, to organize the streams of printed matter 10A–10C relative to each other. To accomplish this task, the printed matter manipulator 352 interrogates a data base 350 to verify proper sequencing or to obtain match information. In one example, the printed matter manipulator 352 is a cutter, feeder, inserter, or accumulator/folder for combining bills into corresponding envelopes. In other examples, the printed matter manipulator 352 could be a binding machine for combining the streams of printed matter 10A–10C into a single multi-page document.

Figure 7:
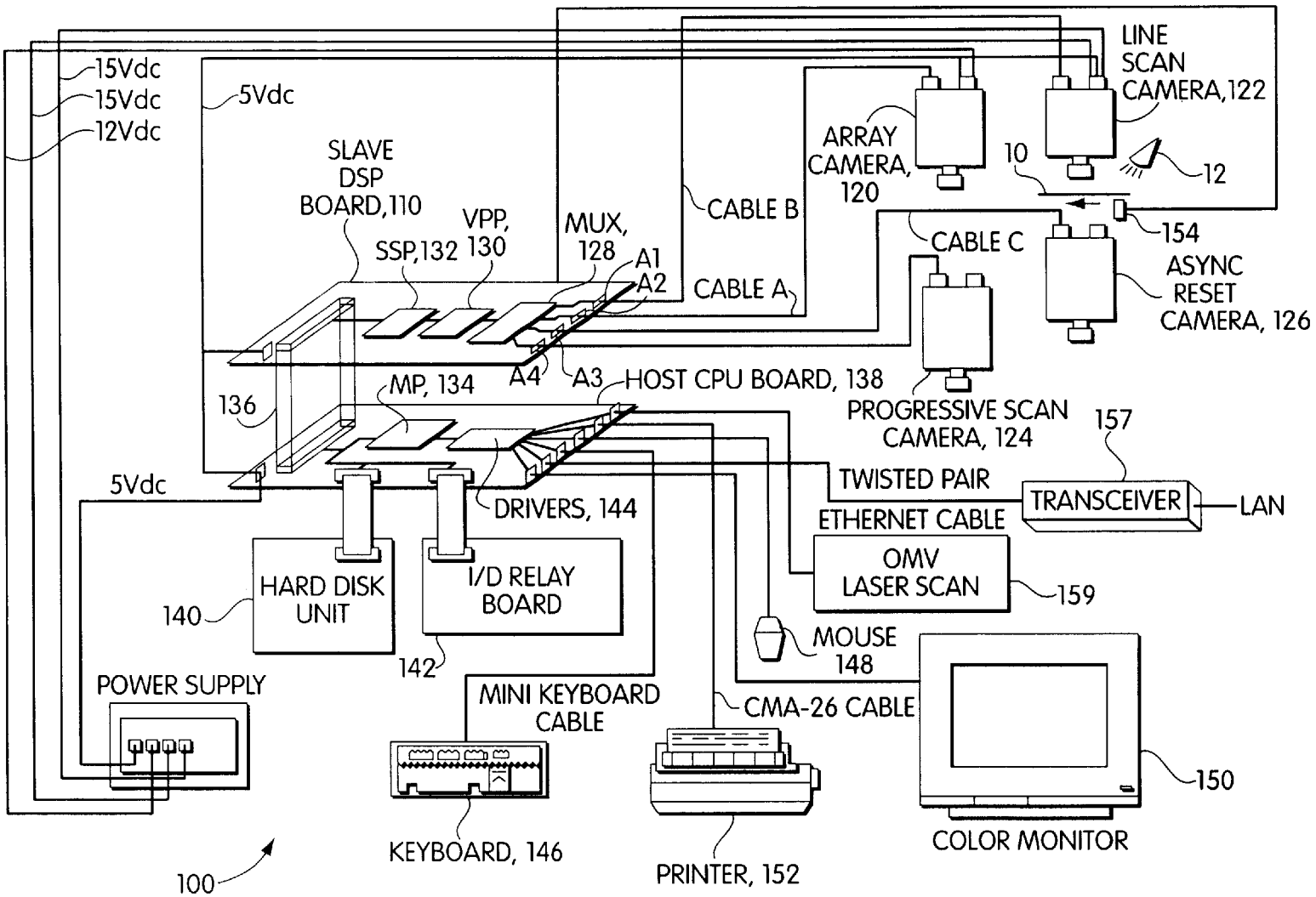
FIG. 7 is a block diagram illustrating a print monitoring system useful for carrying out the present invention.

FIG. 7 is a schematic block diagram illustrating the general organization of the print monitoring system 100 as further disclosed in U.S. patent application Ser. No. 09/016,001, filed Jan. 30, 1998, entitled PRINT MONITORING SYSTEM AND METHOD USING SLAVE SIGNAL PROCESSOR/MASTER PROCESSOR ARRANGEMENT, the contents of which are incorporated herein, in their entirety, by this reference.

In the preferred embodiment, each slave processor (DSP) board 110 has multiple, four for example, video input ports A1, A2, A3, A4. Each video input port A1–A4 has the capability of supporting its own video capture device. As illustrated, potential video capture devices include array cameras 120, line cameras 122, progressive scan cameras 124, and asynchronous reset cameras 126.

In order to time image acquisitions by the cameras, a trigger device 154 detects the movement of printed matter 10 past the cameras. The trigger device 154 can take a number of different configurations depending on the application and the event to be detected. In one case, the trigger device 154 detects the beginning of a sheet of paper using an optical or probe sensor. A signal processor 132 then determines a delay time required for the symbols of interest to enter the field of view of a selected camera. At the expiration of this delay time, the signal processor 132 signals the beginning of an image capture event. In other cases, the trigger device 154 detects symbols on the printed matter, such as lines at predetermined intervals, or movements of the paper handling equipment, using optical or mechanical encoders.

On the slave board 110, an analog multiplexer 128 selects a video signal from one of the video input ports A1–A4 and presents it to a video preprocessor 130. The video preprocessor 130 then converts the selected video signal into a form that can be sampled at a digital signal port of the digital signal processor 132. Specifically, the video preprocessor 130 low pass filters the video signal to compensate for any uneven illumination at the video capture device 120–126 by a printed matter illuminator 12. The video preprocessor 130 also adjusts the level of the video signal by comparing it with a signal level appropriate for communication to the digital signal processor 132 by way of the digital signal port.

The digital signal processor 132 identifies the target print control symbol 214 in the selected video signal by reference to the predetermined position for the print control symbol 214 and the frame bit characters 218, 220.

As suggested by FIG. 7, additional slave DSP boards 110 can be attached to an ISA bus 136. For example, in one implementation, up to four separate slave DSP boards 110 are connected to a host central processing unit (CPU) board 138 via extensions to the bus 136. The use of multiple DSP boards facilitates the coordination and sequencing of multiple streams of printed matter 10A–10C.

In the preferred embodiment, the host CPU board 138 is an Intel-brand 80586 industrial-grade CPU acting as a master processor. The host CPU board 138 connects to a hard disk unit 140, an input/output (I/O) relay board 142, and a memory (not shown) via the bus 136. In the preferred embodiment, the master processor 134 receives, through its set of associated drivers 144, user commands from a keyboard 146 and a mouse 148. The master processor 134 also presents, through its set of associated drivers 144, data to the operator via a monitor 150 or a printer 152. In a preferred implementation, the monitor 150 includes a touch screen to enable the operator to communicate with the host processor 134 without the keyboard 146 or the mouse 148. In the preferred embodiment, the system also includes a network interface card (NIC) 157 connecting the host CPU board 138 to a local area network (LAN) to enable remote control, monitoring, and data logging.

Since the master processor 134 is not burdened with image processing, this task being performed by the slave processors 132, the host CPU board 138 can receive, through its digital input ports, such as the serial port, print monitoring data generated by a laser bar code scanner and/or an optical/magnetic reader 159. This provides the CPU 134 with the ability to acquire additional data directly in addition to receiving data through the slave DSP boards 110.

Figure 8:
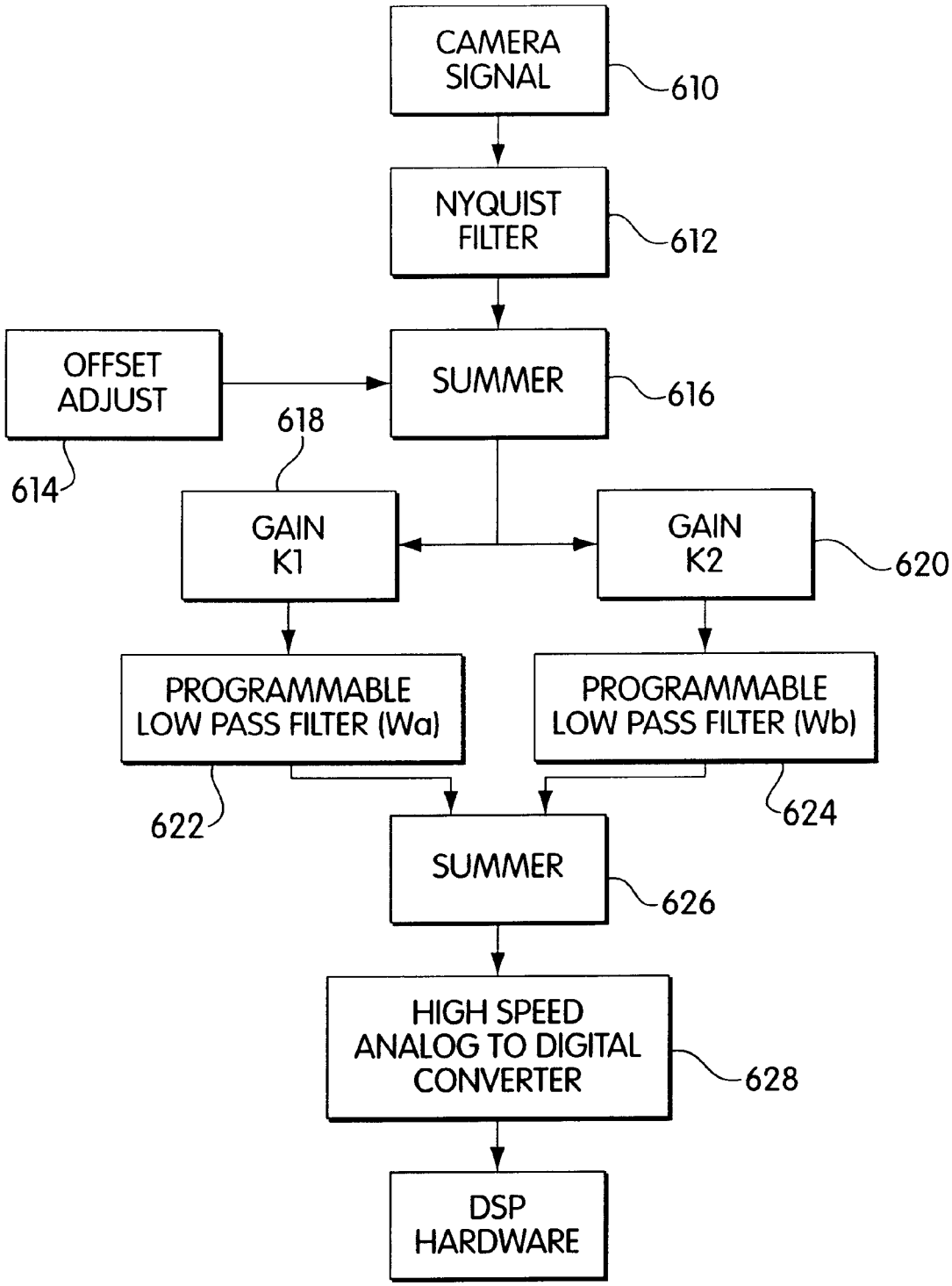
FIG. 8 is a block diagram of the hardware decoding circuit showing video stage analog filtering of the signal from the camera.

FIG. 8 is a block diagram illustrating the signal processing hardware or operations performed on the camera signal.

The illustrated signal processing hardware includes a Nyquist filter 612, a plurality of gain stages 618, 620, and programmable filters 622, 624 that are connected in a configuration that implements programmable dot detection in the midst of a uniform gray level.

The camera signal 610 is conditioned by the Nyquist filter 612 to eliminate all frequencies above the Nyquist rate. The conditioned signal is level shifted in order to eliminate the background level using an offset adjuster 614 and a first summer 616.

The offset-adjusted signal goes through first and second gain stages 618, 620 having gains K1 and K2 respectively. The relationship between K1 and K2 is defined as follows:

i) K1–K2=0 (minimum)

ii) K2 cannot be greater than K1

The output of the first gain stage K1 618 is conditioned by a first programmable low pass filter 622 having a cut-off frequency at Wa and a gain of +1 while the output of the second gain stage K2 620 is conditioned by a second programmable low pass filter 624 having a cut-off frequency at Wb and a gain of −1.

Figure 9A:
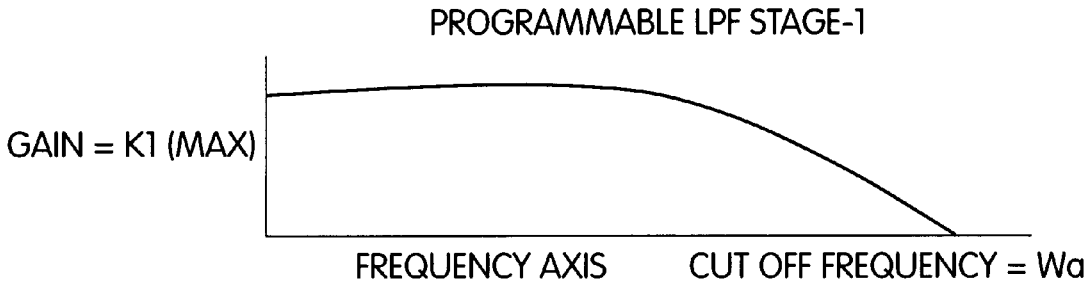
FIGS. 9A, 9B, and 9C are plots showing the spectral response of video stage filters and the spectral response of a combined signal from the filters.
Figure 9B:
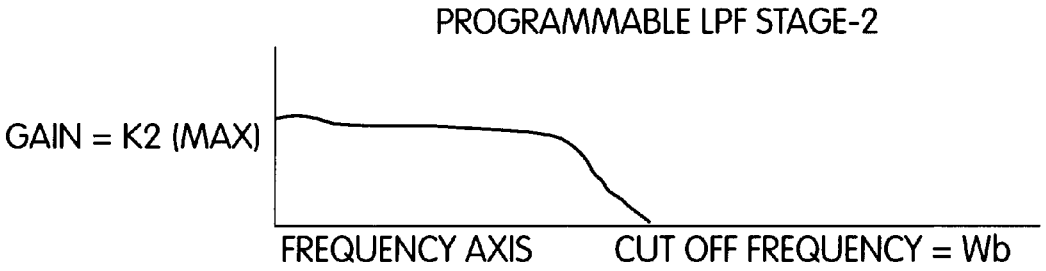

FIG. 9A shows the frequency response of the first programmable low-pass filter (Wa) 622. FIG. 9B shows the frequency response of the second programmable low-pass filter (Wb) 624.

The signals from the first and second programmable low pass filters 622, 624 filters are then combined in a second summer 626.

The full-scale range of signal to A/D Converter 628 is defined as:

(K1 (Wa)–K2 (Wb) ) with the condition that Wa>>Wb.

Figure 9C:
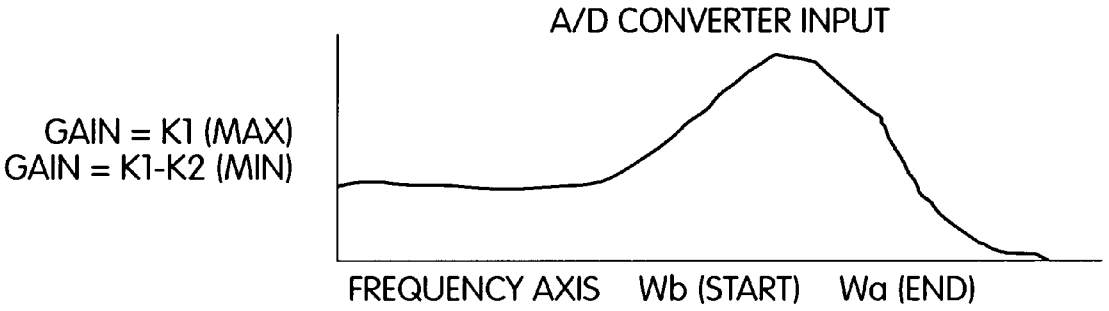

FIG. 9C shows the spectral characteristics of the A/C converter input.

By adjusting the cut-off frequencies (Wa and Wb) of the first and second programmable low-pass filters 622, 624 and the gain parameters K1 and K2, the user can tune the pass-band of the resulting band-pass filter to optimize the edge detection scheme at any web speed.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method for encoding, on an imprintable medium, information identifying said imprintable medium in a manner detectable by a print-monitoring system and invisible to an unaided human observer, said method comprising the steps of:

defining a print-control region on said imprintable medium, defining an identification pattern in said print-control region, said identification pattern having a plurality of locations selected to identify said imprintable medium, imprinting, in each of said locations, a plurality of bit characters detectable by said print-monitoring system and invisible to an unaided human observer by the nature of the size of the bit characters, thereby enabling said identification pattern to be detected and decoded by said print-monitoring system.

2. The method of claim 1 wherein said step of defining a print-control region comprises the step of defining a rectangle having a first corner at a pre-determined location on said imprintable medium.

3. The method of claim 1 wherein said step of defining an identification pattern comprises the step of defining a sequence of identification characters indicative of the identity of said imprintable medium.

4. The method of claim 2 further comprising the step of imprinting a first framing bit character at said first corner, thereby enabling said print-monitoring system to locate said rectangle.

5. The method of claim 4 further comprising the step of imprinting a second framing bit character at a second corner diagonally opposite said first corner.

6. The method of claim 3 further comprising the step of assigning a location to each identifying character in said sequence of identifying characters.

7. The method of claim 3 further comprising the step of assigning a plurality of locations to each identifying character in said sequence of identifying characters.

8. The method of claim 3 further comprising the step of appending a check character to said sequence of identification characters.

9. The method of claim 1 wherein said step of defining an identification pattern comprises the steps of defining an ordered array of intersecting rows and columns defining a plurality of intersections, each of said intersections defining a slot, and said imprinting step comprises the step of selectively imprinting said bit characters in said slots.

10. The method of claim 1 further comprising the step of imprinting error control information in said print control region.

11. The method of claim 9 further comprising the steps of reserving a parity slot in said ordered array, said parity slot being associated with a selected row in said array, and, on the basis of a parity associated with said selected row, imprinting a parity-setting bit character at said parity slot.

12. A system for encoding, on an imprintable medium, information identifying said imprintable medium in a manner detectable by a print-monitoring system said system comprising:

means for defining a print-control region on said imprintable medium, means for defining an identification pattern in said print-control region, said identification pattern having a plurality of locations selected to identify said imprintable medium, means for imprinting, in each of said locations, a plurality of bit characters invisible by the nature of the size of the bit characters and detectable by said machine-vision system, thereby enabling said identification pattern to be detected and decoded by said print-monitoring system.

13. The system of claim 12 wherein said means for defining a print-control region comprises means for defining a rectangle having a first corner at a pre-determined location on said imprintable medium.

14. The system of claim 12 wherein said means for defining an identification pattern comprises means for defining a sequence of identification characters indicative of the identity of said imprintable medium.

15. The system of claim 13 further comprising means for imprinting a first framing bit character at said first corner, thereby enabling said print-monitoring system to locate said rectangle.

16. The system of claim 15 further comprising means for imprinting a second framing bit character at a second corner diagonally opposite said first corner.

17. The system of claim 14 further comprising means for assigning a location to each identifying character in said sequence of identifying characters.

18. The system of claim 14 further comprising means for assigning a plurality of locations to each identifying character in said sequence of identifying characters.

19. The system of claim 14 further comprising means for appending a check character to each of said identification characters.

20. The system of claim 12 wherein said means for defining an identification pattern comprises means for defining an ordered array of rows and columns, each of said rows intersecting each of said columns at a plurality of a slots, and said imprinting step comprises means for imprinting said bit characters at locations defined by said slots.

21. The system of claim 12 further comprising means for imprinting error control information in said print control region.

22. The system of claim 20 further comprising means for reserving a plurality of parity check locations in said ordered array, and, means for imprinting a plurality of parity-setting bit characters at each of said reserved parity check locations on the basis of the parity associated with said rows and columns.

23. The method of claim 10 wherein said step of imprinting error control information comprises the step of selecting a first plurality of bit characters to be representative of said information identifying said imprintable medium and a second plurality of bit characters to be representative of a check digit.

24. The method of claim 23 further comprising the step of selecting said second plurality to be representative of bit characters.

25. The method of claim 24 wherein said imprinting step comprises the step of interleaving said first plurality of bit characters and said second plurality of bit characters.

26. The method of claim 8 wherein said step of appending a check character comprises the step of selecting a check character on the basis of said sequence of identification characters.

27. A method for decoding print-control information encoded in a print-control region imprinted on an imprintable medium, said print-control information being invisible to a human observer and detectable by a print monitoring system, said method comprising the steps of:

locating said print-control region on said imprintable medium, said print control region having a plurality of designated locations for imprinting bit characters;

examining said designated locations to determine a spatial distribution of bit characters imprinted in said print-control region and invisible by the nature of the size of the bit characters;

generating, on the basis of said spatial distribution of bit characters, a bitstream representative of said print-control information in encoded form;

decoding said bitstream, thereby generating a character stream representative of said print-control information in decoded form.

28. The method of claim 27 further comprising the step of obtaining first and second dimensions of said print-control region.

29. The method of claim 27 wherein said step of locating said print-control region comprises the step of locating a framing bit associated with said print-control region.

30. The method of claim 27 wherein said plurality of character streams is encoded in a sequence that differs from said plurality of characters representative of said print-control information in decoded form and said method further comprises the step of reordering said plurality of character streams to generate a sequence of character streams having a sequence consistent with said sequence of characters.

31. The method of claim 27 wherein said print-control region includes parity bits and said step of determining a logical value associated with each designated location comprises the step of verifying that said logical values are consistent with said parity bits.

32. The method of claim 31 further comprising the step of altering a logical value from said bit stream of logical values to be consistent with said parity bit.

33. The method of claim 27 further wherein said sequence of characters includes characters representative of print-control information and a check character, and said method further comprises the step of verifying that said check character is consistent with said characters representative of print-control information.

34. A method for verifying the integrity of print-control information encoded, together with error control information, in a print-control region imprinted on an imprintable medium, said print-control information being invisible to a human observer and detectable by a print monitoring system, said method comprising the steps of:

locating said print-control region on said imprintable medium, said print control region having a plurality of designated locations for imprinting bit characters;

examining said designated locations to determine a spatial distribution of bit characters imprinted in said print-control region and invisible by the nature of the size of the bit characters;

generating, on the basis of said spatial distribution of bit characters, a bitstream representative of said print-control information in encoded form and said error control information;

separating said error control information from said print-control information;

decoding said bitstream, thereby generating a character stream representative of said print-control information in decoded form;

correlating said error control information with said print-control information, thereby verifying the integrity of said print control information.

35. The method of claim 27 wherein said error control information includes parity bits and said correlating said error control information with said print-control information comprises the step of determining a logical value associated with each designated location and verifying that said logical values are consistent with said parity bits.

36. A method for encoding print-control information on an imprintable medium, said print-control information being invisible to an unaided human observer and detectable by a print-monitoring system, said method comprising the steps of:

imprinting a first framing bit at a first selected location on said imprintable medium, said first framing bit marking a first comer of a print control region and invisible by the nature of the size of the first framing bit;

imprinting a second framing bit at a second selected location on said imprintable medium, said second framing bit marking a second corner of said print control region and invisible by the nature of the size of the second framing bit;

defining an array of designated locations in said print control region, imprinting, on each of a plurality of said designated locations, a bit character, thereby forming a spatial distribution of bit characters representative of said print-control information.

37. The method of claim 36 further comprising the step of imprinting, on each of a second plurality of said designated locations, an error-correction character selected to be consistent with said print-control information represented by said spatial distribution of bit characters.

38. The method of claim 27 wherein said step of obtaining said first and second dimensions comprises the step of retrieving said first and second dimensions from a memory location.

39. The method of claim 27 wherein said step of obtaining said first and second dimensions comprises the steps of detecting the locations of a plurality of bit characters imprinted on said imprintable medium;

determining, on the basis of said locations, said first and second dimensions of said print-control region.

40. The method of claim 27 wherein said step of generating a bitstream comprises the step of determining a logical value associated with each designated location on the basis of the presence or absence of a bit character imprinted at said designated location, thereby generating a bitstream of logical values representative of said print-control information in encoded form.

41. The method of claim 40 wherein said step of decoding said bitstream comprises the steps of grouping said logical values from said bit stream into a plurality of character streams representative of said print-control information in encoded form; and mapping said plurality of character streams into a plurality of characters representative of said print-control information in decoded form.

* * * * *